United States Patent [19]

Claydon et al.

[11] 3,948,427

[45] Apr. 6, 1976

[54] APPARATUS FOR DRIVING A LENGTH OF WIRE, ROD OR OTHER ELONGATED BODY THROUGH A WORKPIECE FOR EXAMPLE FOR RIVETING

[75] Inventors: Derek George Wilson Claydon, Drayton, near Banbury; Gilbert George Hill, Bodicote, near Banbury, both of England

[73] Assignee: Alcan Research and Development Limited, Montreal, Canada

[22] Filed: Sept. 27, 1974

[21] Appl. No.: 509,745

Related U.S. Application Data

[62] Division of Ser. No. 257,204, May 26, 1972, abandoned.

[30] Foreign Application Priority Data

June 2, 1971 United Kingdom..... 18697/71

[52] U.S. Cl. ..... 227/97; 29/432; 29/522; 29/243.54

[51] Int. Cl.[2] ..... A43D 69/12; B27F 7/00

[58] Field of Search..... 29/432, 522, 243.54, 200 B; 227/97

[56] References Cited

UNITED STATES PATENTS

| | | | |
|---|---|---|---|
| 588,236 | 8/1897 | Noyes | 227/52 |
| 1,446,095 | 2/1923 | Karaus | 29/432 UX |
| 2,328,821 | 9/1943 | Lyon | 29/526 A UX |
| 2,494,096 | 1/1950 | Kellogg | 227/97 |
| 2,593,506 | 4/1952 | Wales | 29/432 |
| 3,485,432 | 12/1969 | Lagasse et al. | 227/97 |
| 3,491,930 | 1/1970 | Hill | 227/92 |

*Primary Examiner*—Charlie T. Moon

*Attorney, Agent, or Firm*—Cooper, Dunham, Clark, Griffin & Moran

[57] ABSTRACT

A riveting apparatus comprises first and second dies having plane forward end faces for gripping a workpiece over a substantial area round the location to be riveted. The dies have aligned bores which open to said end faces and which are the same as each other in cross section, and a punch and a plunger corresponding to the shape of the bores are slidably mounted in the bores of the first and second dies respectively. A hydraulic piston operates the punch and the forward movement of the punch along the bore of the first die can be terminated by a stop selectively either with the punch and flush with or a predetermined distance short of the end face of the first die. The plunger can be moved hydraulically along its bore toward the punch. In operation of the apparatus, a headless pin is driven through an imperforate workpiece and thereafter each end of the pin is upset while the pin is prevented from moving lengthwise of itself relative to the workpiece.

8 Claims, 13 Drawing Figures

101
102
A
B
103
103
B
A

APPARATUS FOR DRIVING A LENGTH OF WIRE, ROD OR OTHER ELONGATED BODY THROUGH A WORKPIECE FOR EXAMPLE FOR RIVETING

This is a division of application Ser. No 257,204 filed May 26, 1972, now abandoned.

This invention relates to riveting apparatus or other elongate body through sheet.

According to the present invention there is provided riveting apparatus comprising a first die having a plane forward end face and a bore to receive a length of wire, rod or other elongate body which is to form a rivet, a second die having a plane forward end face and a bore of the same cross section as and aligned with the bore of the first die, the bores of the two dies opening to the plane forward end faces, the second die being hydraulically movable toward the first die to grip the work material between the forward end faces of the two dies, a punch which conforms to the shape of the bores and which is movable hydraulically along the bore in the first die toward the second die, a plunger which is slidably mounted in the bore in the second die, and which is movable hydraulically along the bore in the second die toward the first die, and means selectively operable to cause the forward movement of the punch to terminate at a position either short of or flush with the forward end of the first die.

The length of wire or rod may be cut from a supply length of such material at a first station and then transferred to the bore in the said one die.

Figure 1:
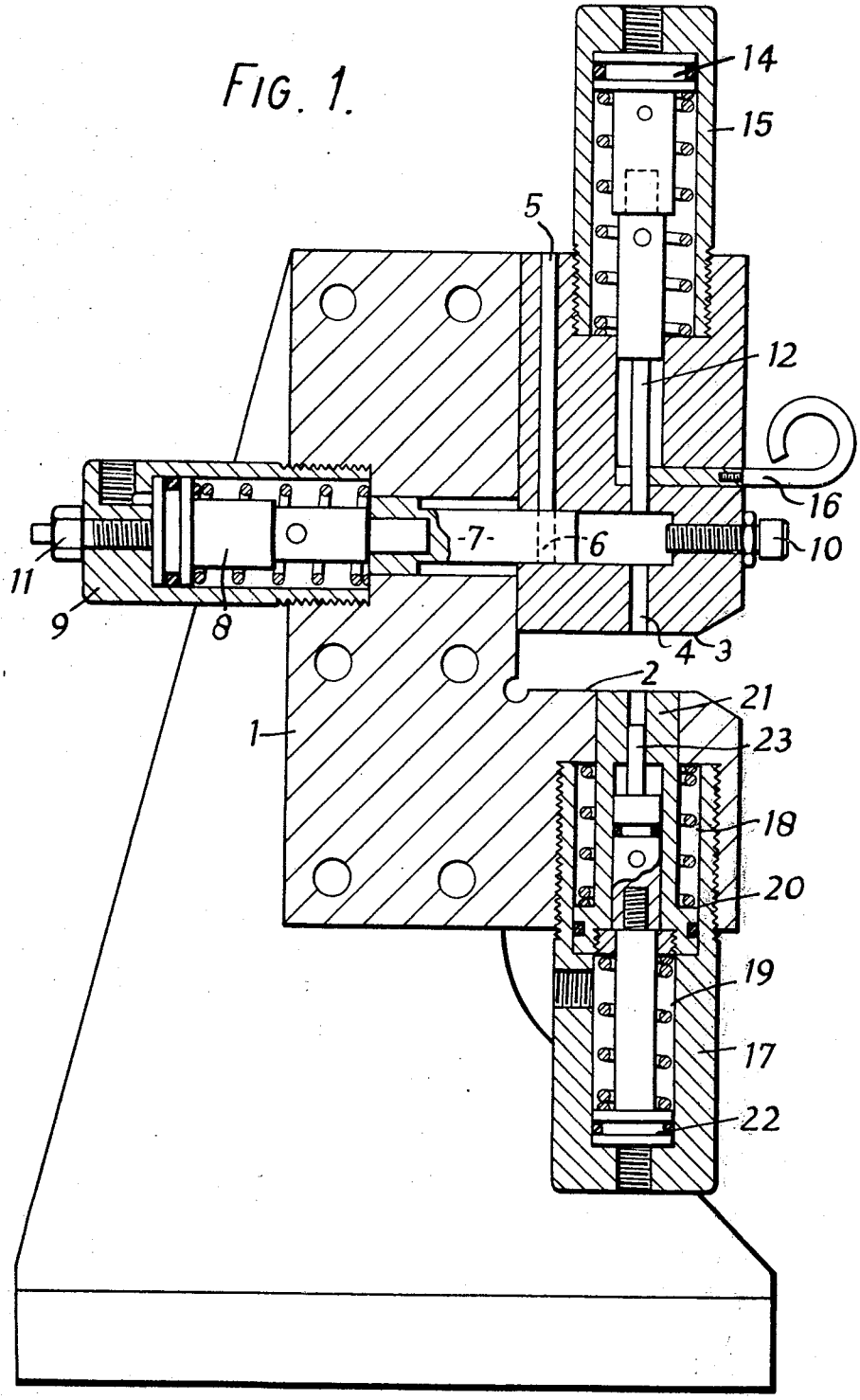
Figure 2:
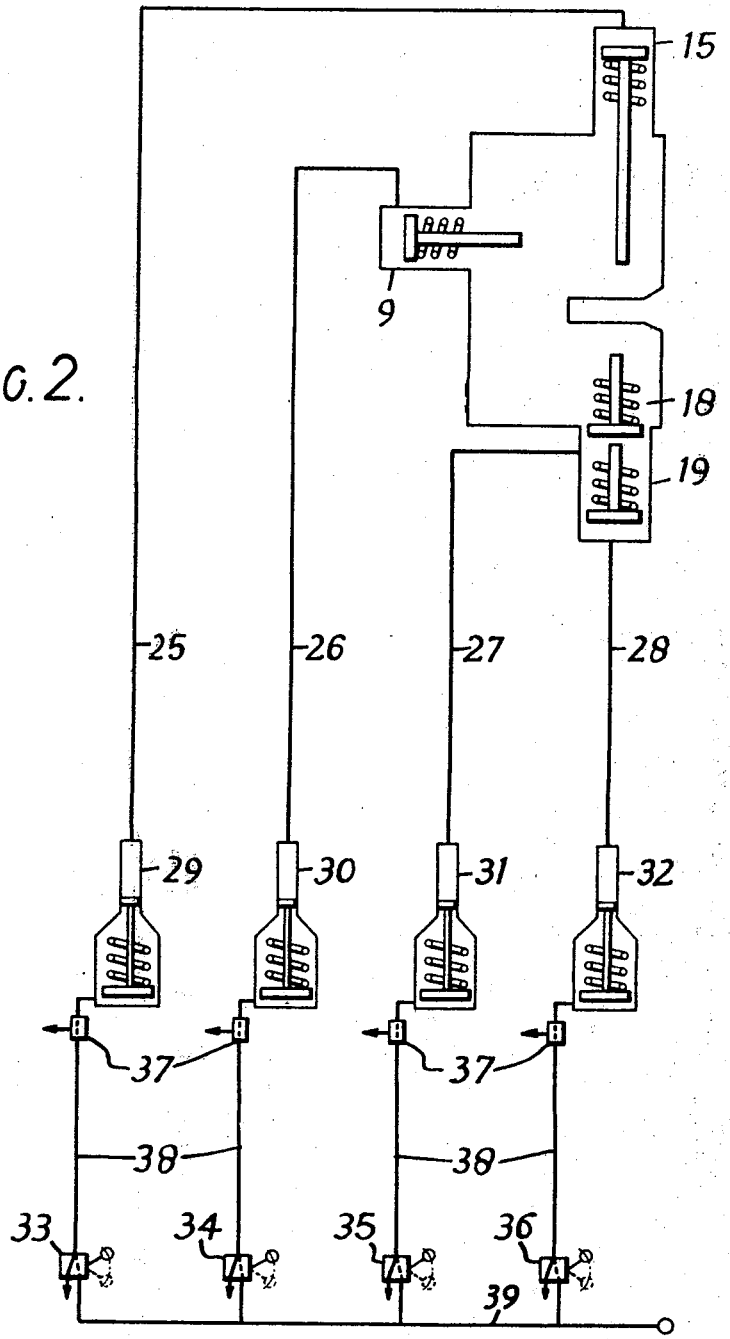
Figure 3:
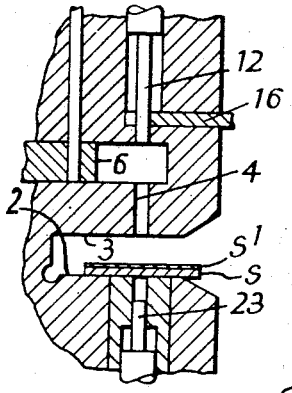
Figure 11:
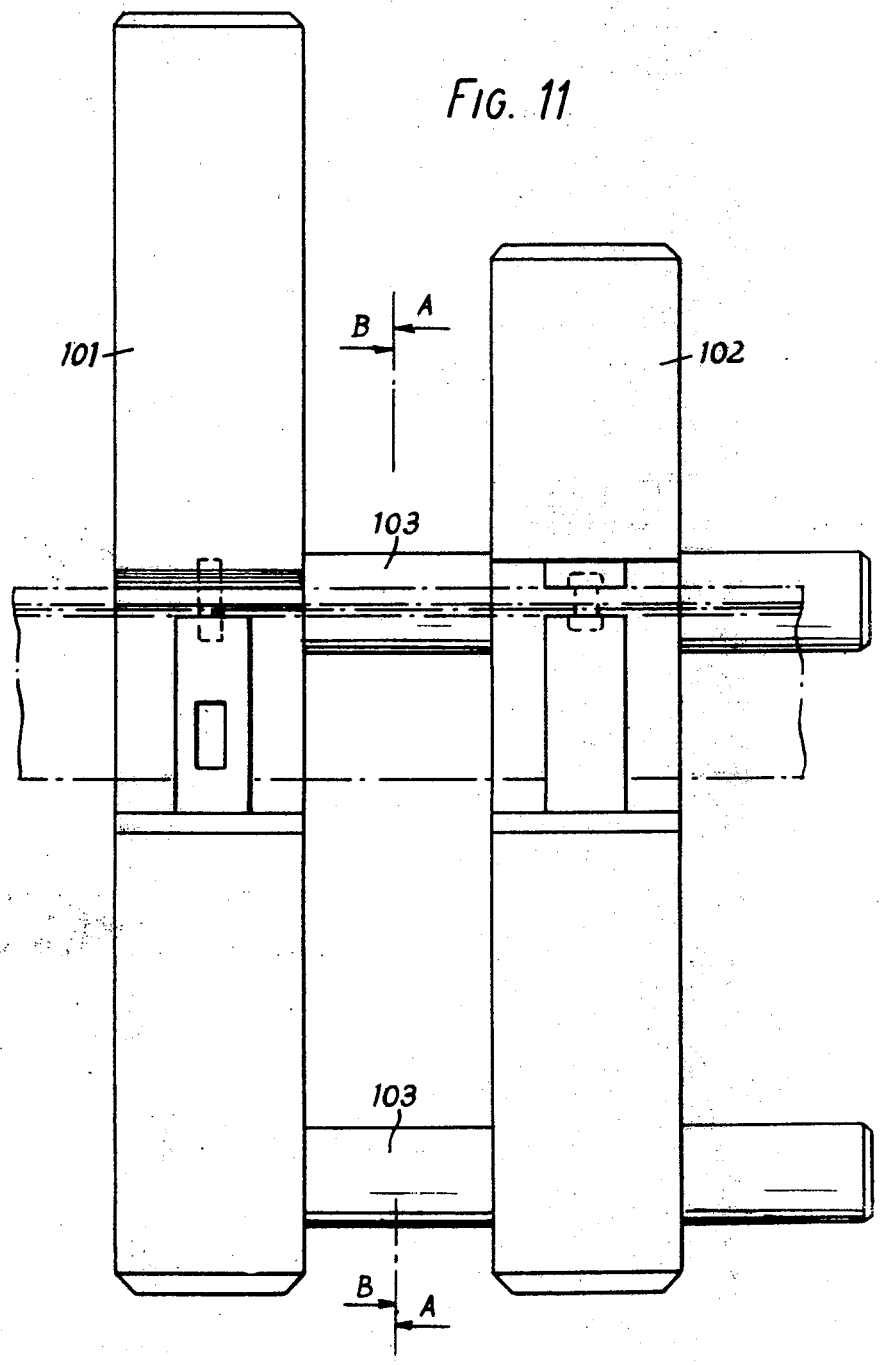
Figure 12:
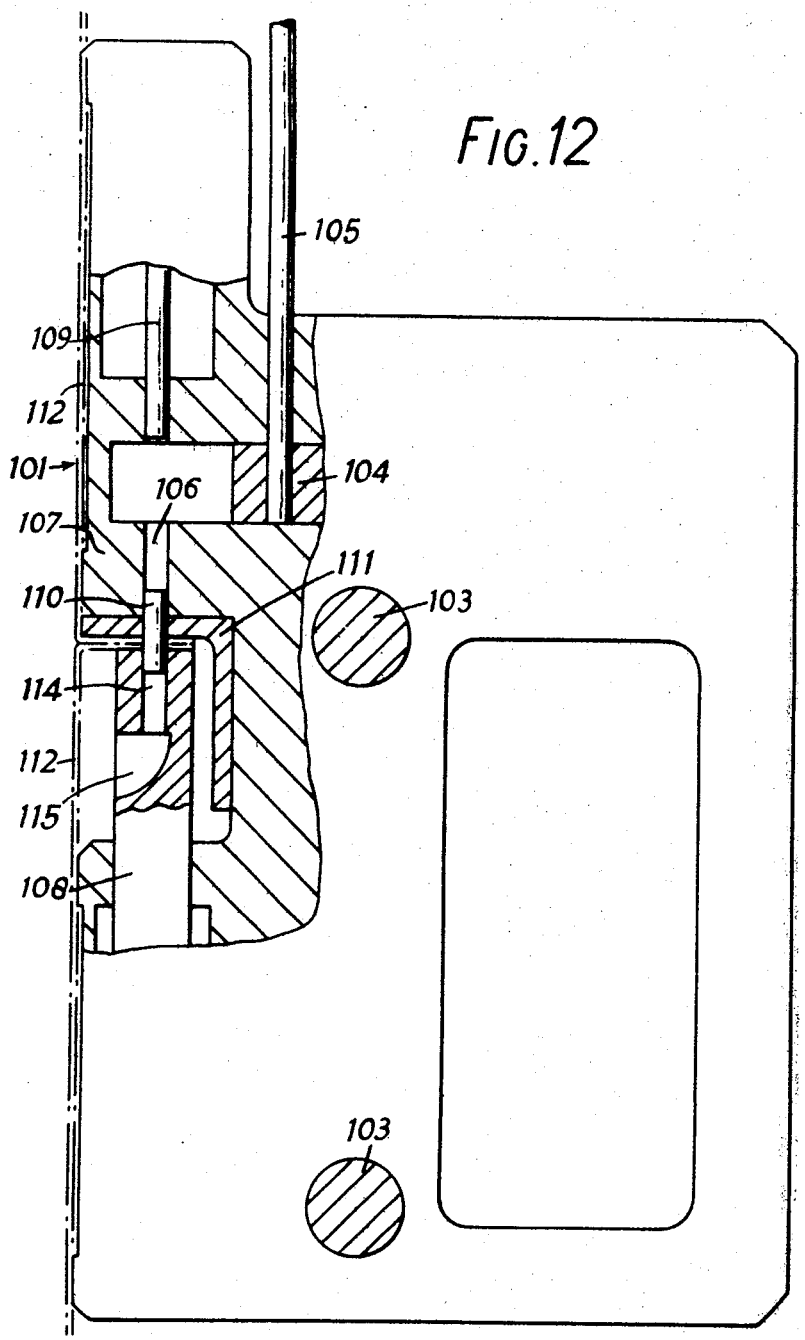
Figure 13:
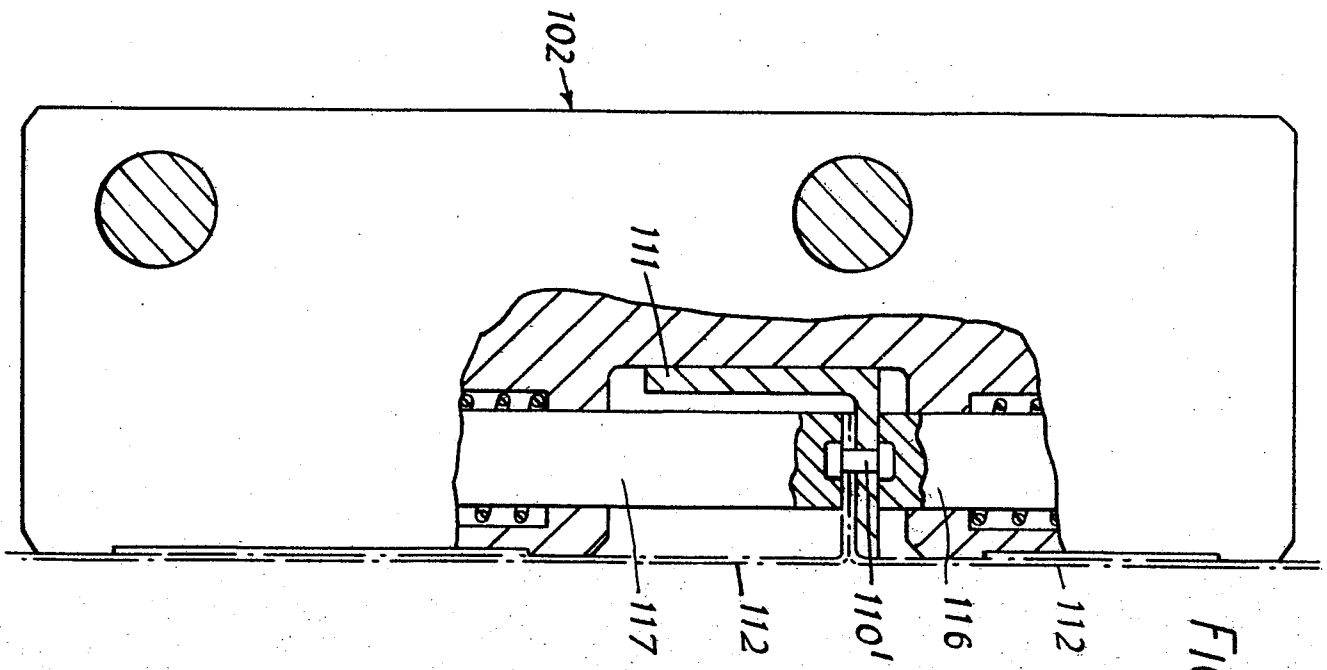

The invention will now be described in more detail with reference by way of example to the accompanying drawings, wherein:

FIG. 1 is a side view, partly in section, of one form of apparatus according to the invention, FIG. 2 is a diagram of the hydropneumatic system of the apparatus of FIG. 1, FIGS. 3 to 10 illustrate diagrammatically the sequence of operations in use of the apparatus for riveting, FIG. 11 is a front view of an alternative form of apparatus, FIG. 12 is a section on line A—A of FIG. 11, and FIG. 13 is a section on line B—B of FIG. 11.

The apparatus illustrated in FIG. 1 comprises a fixed frame 1 defining a table 2 upon which work to be riveted is assembled. A fixed die 3 secured to the frame 1 is arranged over the table 2 and provides a die bore 4. Rivet wire stock is fed down a guideway 5 in the frame 1 to enter a bore 6 in a shear block 7, which is driven by a piston 8 in cylinder 9. When pressure fluid enters the cylinder 9 the shear block moves forwardly to shear off a piece of wire, the length of which is determined by the thickness of the shear block 7, and the shear block 7 transports the wire length to bring it into register with the bore 4. The limits of movement of the shear block 7 are set by adjusting screws 10 and 11.

A punch 12 is driven by a piston 14 in a cylinder 15 and, in the retracted position shown in FIG. 1, the lower end of the punch 12 is guided in an aperture in the die 3 aligned with the die bore 4, so that the punch 12 can, when the bore 6 in the shear block is aligned with the bore 4, enter and pass through the shear block 7 to drive a transported wire length downwardly through the bore 4. A punch stop 16, shown as being manually operable, is movable between an operative position in which it arrests the downward movement of the punch at a position in which its lower end is within the die bore 4 and an inoperative position in which it permits the lower end of the punch to descend until piston 14 reaches the bottom of its cylinder, at which point the end of punch 12 is substantially flush with the lower surface of die 3.

A cylinder 17 is secured in the lower part of the frame 1 and is provided with bores 18 and 19. In the bore 18 there is a piston 20 which forms part of a second die 21, whilst in the bore 19 there is a piston 23 to drive an extractor and heading punch or plunger 23. Piston 22 is entrained by piston 20 and has a limited degree of freedom of axial movement in relation to it. The plunger 23 can move in relation to support member 21 only between the retracted position shown in FIG. 1 and an extended position in which the end of the plunger 23 extends a little above the support member 21.

The pistons 8, 14, 20 and 22 are driven in the outward direction by the supply of hydraulic fluid under pressure to their associated cylinders 9, 15, 18 and 19 and in the return direction by return springs. The supply of hydraulic fluid to these cylinders is respectively via lines 25, 26, 27 and 28 from hydropneumatic boosters 29, 30, 31 and 32 respectively. The boosters 29, 30, 31 and 32 each consist of interlinked pistons respectively arranged in small diameter hydraulic cylinders and large diameter air cylinders. Pneumatic pressure is supplied from an air pressure line 39, via manually operated valves 33, 34, 35 and 36, which are three-position valves, operable to admit air under pressure from line 39 to air supply line 38, to exhaust supply line 38 or to hold pressure in supply lines 38, according to position. Associated with each supply line 38 is a rapid exhaust valve 37, which opens to exhaust the air cylinder of the associated hydropneumatic booster when the line 38 is exhausted to atmosphere by operation of the associated valve. The parts 29 to 39 could be replaced by a single hydraulic pump feeding the lines 25 to 28 through valves which have the same functions as the valves 33 to 36.

Turning now to FIGS. 3 to 10, FIG. 3 shows the start position with all the pistons in their retracted positions, the bore 6 of the shear block aligned with wire guide 5 with the leading end of the wire fed into the shear block 7 and the punch stop 16 in position to arrest the movement of the punch 12.

Figure 4:
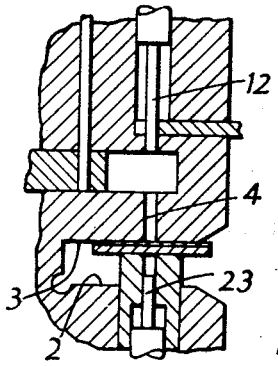
Figure 5:
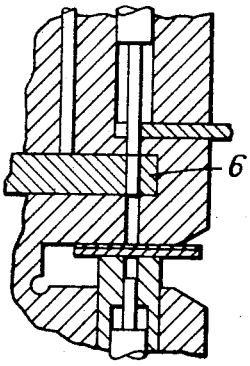
Figure 6:
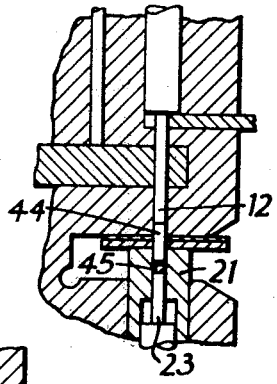
Figure 7:
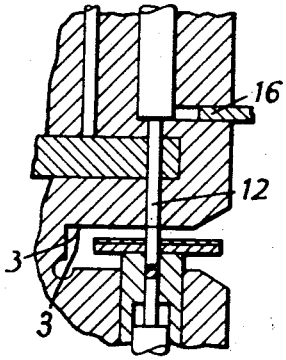
Figure 8:
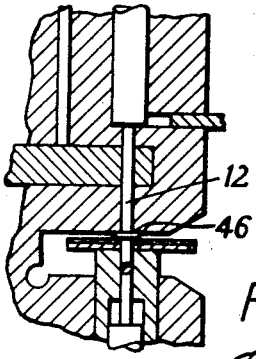
Figure 9:
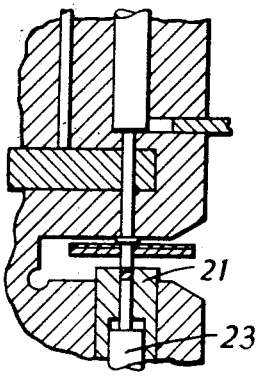
Figure 10:
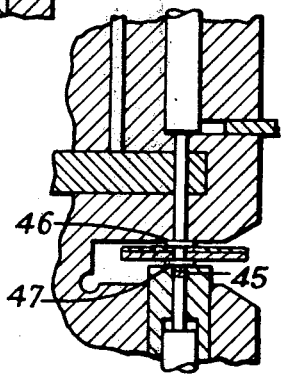

The first operation is to place the sheets S and S′ to be riveted on the table 2, the thicker sheet S (if one sheet is thicker) preferably being nearest to the table. The die 23 is then raised to clamp the sheets S, S′ against the lower surface of die 3 (FIG. 4). Next, air is admitted to hydropneumatic booster 30 to actuate the shearing block 7 to shear off a wire length and transport it to a position in which it is aligned with punch 12 and bore 4 (FIG. 5). The valve 33 is then operated to admit pressure air to hydropneumatic booster 29 and the admission of pressure air is continued until movement of piston 14 and punch 12 is arrested by stop 16 (FIG. 6). At this point the lower end of punch 12 is within bore 4 of die 3. The wire length 44 has been driven through the sheets, S, S′, displacing a slug 45 into the space within the member 21. The two ends of the wire length 44 project from opposite sides of the assembly sheets S, S′. By operating valve 35 to release pressure from cylinder 18 and by withdrawing punch stop 16, the punch 12 moves downward to the limit position shown in FIG. 7 in which it has stripped the top end of the wire length from the bore 4 of die 3 and has reached a position in which its lower end is flush with the lower surface of die 3. By operation of the valve 35 to admit pressure air to booster 31, the support member 21 is caused to rise and thus upset the upper end of wire length 44 to form rivet head 46 (FIG. 8). The valve 35 is then operated to release pressure from cylinder 18 and valve 36 is operated to admit pressure to cylinder 19 thus causing the extractor punch 23 to rise to bring the lower end of wire length 44 clear of the support member 21 (FIG. 9). By maintaining pressure in cylinder 19 and operating valve 35 to readmit pressure to cylinder 18 the lower end of the wire length is upset to form a lower rivet head 47 (FIG. 10), thus completing the riveting operation.

Air pressure is then released from booster 31, allowing punch 23 to rise and eject slug 45 which is removed by means of an air blast. Pressure is then released from booster units 29, 30, 31 and 32 to allow the movable members to return to their start position (shown in FIG. 1) by the action of their respective return springs. The stop member 16 is similarly returned to its start position.

It will be understood that the stop 16 may also be driven by similar means to the other movable members. The sequence of operations controlled by valves 33 to 36 may be carried out automatically with the actuation of the valve being performed in sequence and with interlocks to prevent damage to the parts by reason of any malfunction.

In almost all riveting operations involving metal sheets it is desirable to utilize rivets formed of the same metal as the sheets to be joined by riveting to avoid galvanic corrosion either of the rivet or of the area of the plates surrounding the rivet. The method and apparatus described above have been found to enable this to be done without first drilling holes to receive the rivets. With this apparatus aluminium rivets have been driven not only through aluminium sheets but through steel sheets and plastics sheets. Also, rods of hard nylon, soft nylon, steel, brass, copper, lead, the materials known as Sindanyo, Tufnol, Perspex Orkot and Fibreglass, and even wood have been driven through aluminium sheets by this method. The relative hardnesses of the materials of the rod and the sheet or other components imposes no inherent limitation on the application of the method provided that the material of the rod is capable of being compressed into a compact body free from voids. This compression is effected in the bore 4 of die 3 by the punch 12. Where the material of the rod to be forced through the sheet material or other workpiece is a metal or other solid substance softer than that of the workpiece, plastic deformation of the substance occurs until it forms a compact body bounded by the wall of the bore 4, the workpiece and the punch. In effect, in these circumstances, the compact body which is forced through the sheet material is produced from the rod within the die during the initial movement of punch 12. Where the material of the rod to be forced through the sheet material requires compaction the length of the bore 4 of the stroke of the punch are made sufficient to hold the required initial length of rod and to enable the compaction of the material and its subsequent driving through the workpiece to take place. Clearly where the rod is to be formed into a rivet, it will be required to have an appropriate degree of ductility.

The method and apparatus described above have also been used to punch nylon rod through cardboard, e.g. for riveting purposes. Paper can be punched in the same way but it is preferable to clamp the paper over a large area surrounding the location of the punching.

The method has also been used to punch nylon tube through a workpiece by placing a disposable mandrel in the tube during the punching operation so as effectively to form a solid rod. The mandrel can be removed after punching or may be left in the punched tube to form a plug, if desired.

It will be understood that the wire or rod which is punched through the workpiece can have a non-circular or other desired cross-section. Where it is required to form rivets of square cross-section, for example, it is only necessary to make a pair of dies 3, 21 having a bore of the required square cross-section and a punch of corresponding cross-section. In many instances, depending on the materials of the rivet and workpiece, there is no need to prepare wire or rod of square cross-section because round wire or rod can be brought to the required cross-section in the bore 4 of die 3 during the punching process.

In the apparatus illustrated in FIGS. 11 to 13, the driving of a wire length is performed by a shearing and punching tool 101 and the upsetting of the ends of a driven wire length is performed by a heading tool 102. The tools 101 and 103 are slidably mounted on guide rails 103, so that the lateral spacing between tools 101 and 102 may be set at the pitch distance between adjacent rivets.

The tool 101 includes a wire shear block 104, which is apertured to receive the leading end of aluminium wire 103, advanced from a supply reel. The block 104 transports a shorn wire length to bring it into register with a bore 106 in a fixed upper jaw 107 which constitutes the upper die, against which the work to be riveted is clamped by a clamping piston 108, the upper end portion of which constitutes the lower die. A driving punch 109 is arranged to drive the wire length 110 through the clamped work, which, as illustrated, comprises a relatively thick angle member 111, which is to be riveted to abutting flanges of two relatively thin metal sheets 112. The lower end of wire length 110 enters an axial aperture 114 in clamping piston 108 and the slug thus formed falls out through slot 115 in the side of the piston 108. The work is then moved laterally relatively to the tool 101 to bring the driven wire length 110 into register with the heading tool 102. The heading tool 102 incorporated an upper stationary anvil 116 and a pressure piston 117, both of which are provided with recesses for appropriately shaping the ends of the wire length 110 to form it into a rivet 110'. The upward movement of the pressure piston 117 is synchronised with the movement of the clamping piston 108 so that together they form a table for raising and lowering the work. All the movable parts of the apparatus are driven hydraulically or hydropneumatically in the same way as in the apparatus of FIGS. 1 to 10.

The tool can be made to be held manually or mechanically and designed in several ways with a throat depth to suit the type of joint and the joint location in the assembly. For example it may be manually operated with a small throat as illustrated in FIGS. 11 to 13 or be bench mounted with the desired throat depth as illustrated in FIG. 1. Alternatively the top and bottom of the tool illustrated in FIG. 1 may be split horizontally and the two parts mounted in register either a. on a C-frame or b. on a gantry frame as a single tool or in banks to drive many rivets simultaneously.

We claim:

1. Apparatus for driving a length of wire, rod or other elongate body through a workpiece, comprising first and second dies which are formed with aligned bores, means for moving at least one of the dies towards and away from the other die, while maintaining the alignment of the bores in the dies, for releasably clamping the workpiece between the dies, a punch which conforms to the cross-sectional shape of the bore in the first die, and means for driving the punch along the bore in the first die towards the second die, and stop means for checking the forward movement of the punch selectively at a first position in which the leading end of the punch is flush with the end of the bore in the first die nearer the second die or a second position short of said first position.

2. Apparatus for driving a length of wire, rod or other elongate body through a workpiece, comprising first and second dies which are formed with aligned bores, means for moving at least one of the dies towards and away from the other die, while maintaining the alignment of the bores in the dies, for releasably clamping the workpiece between the dies, a punch which conforms to the cross-sectional shape of the bore in the first die, and means for driving the punch along the bore in the first die towards the second die, the second die having a plunger slidably mounted in the bore thereof which plunger is movably along the bore towards the first die for ejecting material from the bore of the second die, the second die being movable towards and away from the first die by the moving means, the plunger being movable selectively with or independently of the second die and being locatable in a position in which the face of the plunger is flush with that end of the bore in the second die nearer the first die.

3. Riveting apparatus comprising a first die having a plane forward end face and a bore to receive a length of wire, rod or other elongate body which is to form a rivet, a second die having a plane forward end face and a bore of the same cross section as and aligned with the bore of the first die, the bores of the two dies opening to said plane forward end faces, the second die being hydraulically movable towards the first die to grip the work material between said forward end faces of the two dies, a punch which conforms to the shape of the bores and which is movable hydraulically along the bore in the first die towards the second die, a plunger which is slidably mounted in the bore in the second die, and which is movably hydraulically along the bore in the second die towards the first die, and means selectively operable to cause the foward movement of the punch to terminate at a position either short of or flush with the forward end of the first die.

4. Apparatus as claimed in claim 3, wherein the plunger is carried by the second die for movement with the second die and is movable forward hydraulically relative to the second die.

5. Apparatus as claimed in claim 4, further comprising a fixed cylinder which is coaxial with the second die and a piston mounted in said fixed cylinder and connected to the plunger, the piston being spring-biased to urge the plunger rearwardly away from the first die and being operable by fluid pressure in the fixed cylinder to urge the plunger forward against the spring force towards a position flush with the forward end of the second die.

6. Apparatus as claimed in claim 3, wherein the selectively operable means comprises a stop which is movable laterally with respect to the punch between an operative position, in which the stop checks forward movement of the punch beyond said position short of the forward end of the first die, and an inoperative position.

7. Apparatus as claimed in claim 3, further comprising means for severing a length of wire or rod from a supply length at a first station and means for transporting the severed length to the bore in the first die for driving along the bore by the punch.

8. Apparatus as claimed in claim 7, wherein the means for severing the length of wire or rod and the means for transporting the severed length comprise a shear block which has a bore therethrough and which is mounted for guided movement in a direction transversely to the bore in the first die between a first station, in which the bore in the block has one end blanked off and the other end open to receive the leading end of the supply length of the wire or rod, and a second station in which the block is disposed between the leading end of the punch and the first die and has the bore therein aligned with the bore in the first die, a stationary part which cooperates with the block to shear off the length of wire or rod confined in the bore in the block as the block moves from said first to said second station, and means for moving the block between said first and second stations.

* * * * *